US005788605A

United States Patent [19]

Kuo

[11] Patent Number: 5,788,605

[45] Date of Patent: Aug. 4, 1998

[54] RESISTANCE MECHANISM FOR AN EXERCISING DEVICE

[76] Inventor: Hai Pin Kuo, P.O. Box 82-144, Taipei, Taiwan

[21] Appl. No.: 825,641

[22] Filed: Apr. 4, 1997

[51] Int. Cl.[6] ..... A63B 21/005

[52] U.S. Cl. ..... 482/5; 482/136

[58] Field of Search ..... 482/1, 4–7, 52, 482/133, 136, 137, 503; 601/5, 23, 26, 29, 33–35

[56] References Cited

U.S. PATENT DOCUMENTS

| | | | |
|---|---|---|---|
| 4,620,703 | 11/1986 | Greenhut | 482/4 |
| 4,765,613 | 8/1988 | Voris | 482/5 |
| 5,569,121 | 10/1996 | Sellier | 482/5 |

*Primary Examiner*—Richard J. Apley
*Assistant Examiner*—John Mulcahy
*Attorney, Agent, or Firm*—A & J

[57] ABSTRACT

A resistance mechanism for an exercising device includes a frame, a bi-directional electric motor installed on the frame and provided with an output axle, a pulley fixedly mounted on the output axle and formed with two parallel circular grooves, an idle wheel rotatably arranged on the frame, a first belt having one end connected with one of the grooves of the pulley and wound thereon in a direction, a second belt having one end connected with another one of the grooves of the pulley and wound thereon in an opposite direction and engaged with the idle wheel, and an oscillating arm having one end pivotally connected with the axle of the exericsing device and another end fixedly connected with another end of the first belt and another end of the second belt, whereby a resistance force will be applied to the axle when the electric bi-directional motor is turned on.

1 Claim, 8 Drawing Sheets

RESISTANCE MECHANISM FOR AN EXERCISING DEVICE

BACKGROUND OF THE INVENTION

1. Field of the Invention

This invention is related to a resistance mechanism and in particular one for an exercising device.

2. Description of the Prior Art

It has been found that the prior art resistance mechanism for an exercising device generally includes a pin 951, a vertical shaft 960 formed with a plurality of holes 961 adapted to receive the pin 951, and a plurality of weights 962 mounted on the vertical shaft 961 (see FIGS. 7 and 8). The mechanism utilizes the pin 951 to adjust the number of the weights 962 to be lifted by an user. However, such a mechanism is too bulky and difficult to adjust and furthermore, the direction of the resistance produced by the mechanism cannot be changed thereby rendering it very inconvenient to use.

Therefore, it is an object of the present invention to provide an improved resistance mechanism for an exercising device which can obviate and mitigate the above-mentioned drawbacks.

SUMMARY OF THE INVENTION

This invention is related to an improved resistance mechanism for an exercising device.

It is the primary object of the present invention to provide a mechanism which can provide resistance to an exercising device in two opposite directions as desired.

It is another object of the present invention to provide a resistance mechanism for an exercising device which is simple in construction.

It is still another object of the present invention to provide a resistance mechanism for an exercising device which is cheap to manufacture.

It is still another object of the present invention to provide a resistance mechanism for an exercising device which is easy to operate.

It is a further object of the present invention to provide a resistance mechanism for an exercising device which is facile to maintain.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
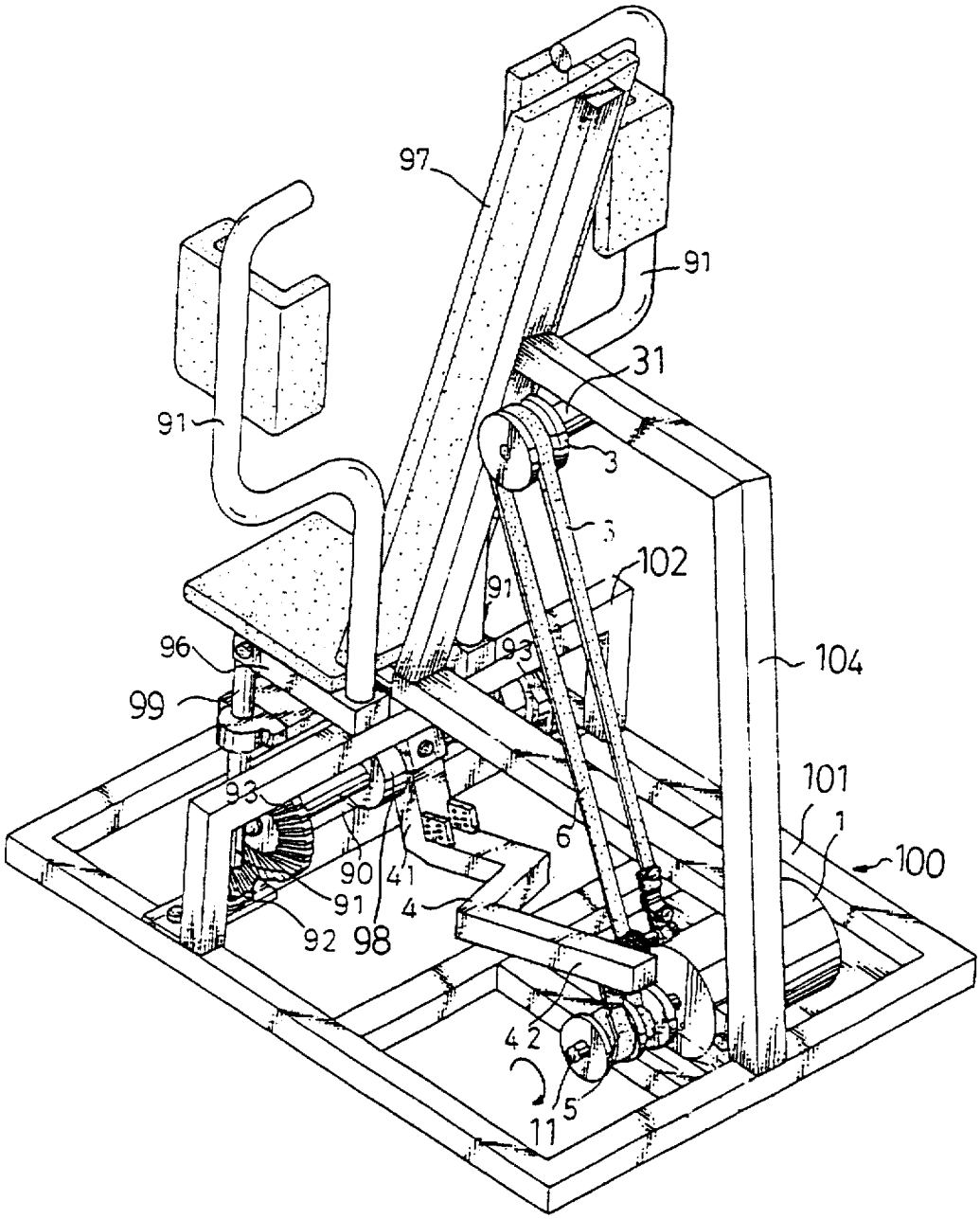
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
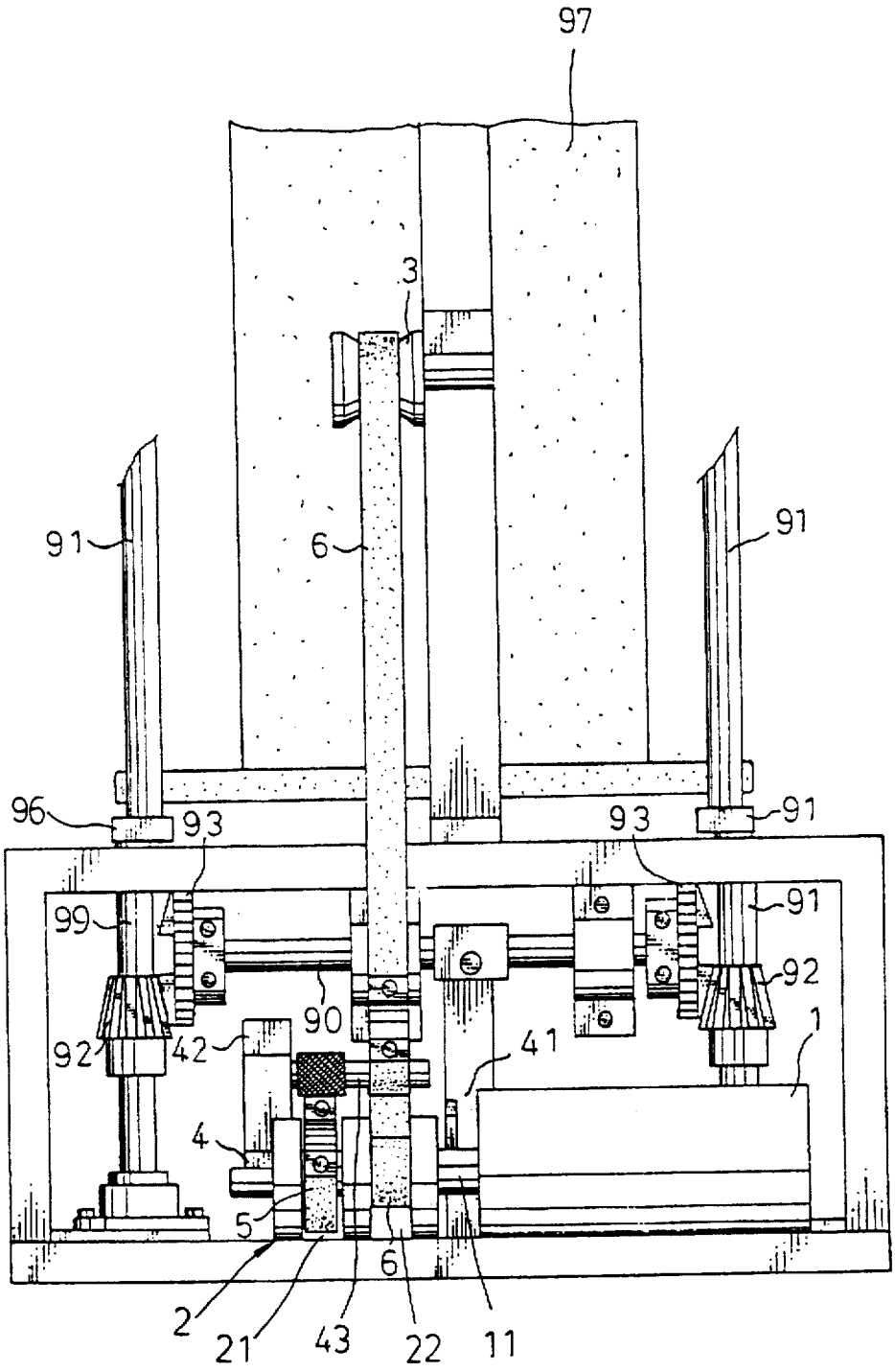
FIG. 2 is a front view of the present invention.
Figure 3:
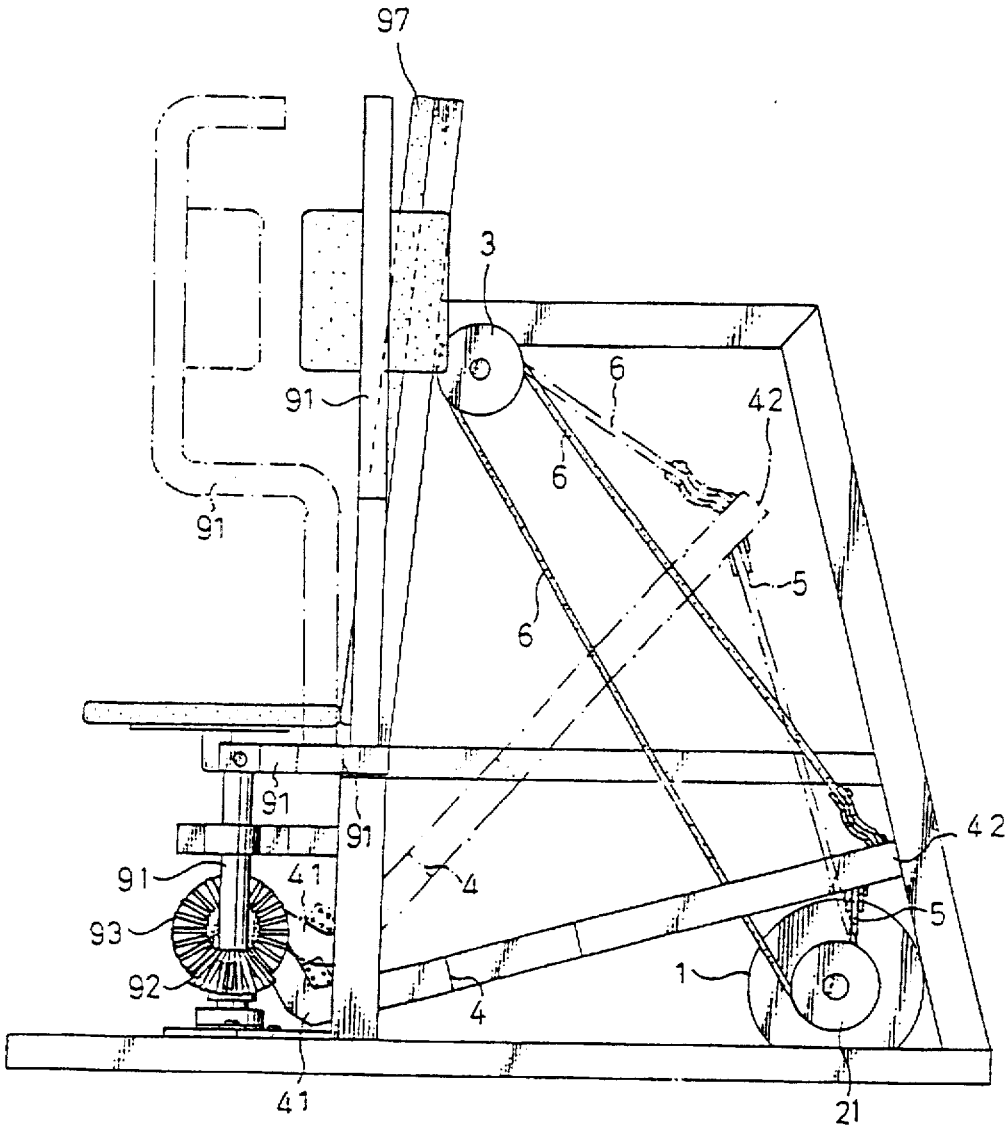
FIG. 3 is a side view of the present invention.

With reference to the drawings and in particular to FIGS. 1 and 2 thereof, the resistance device for an exercising device according to the present invention mainly comprises a frame 100, a bi-directional electric motor 1, a pulley 2, an idle wheel 3 and an oscillating arm 4.

The frame 100 includes a rectangular base 101, an inverted U-shaped member 102, and a mounting 104 having one end installed on the inverted U-shaped member 102 and another end on the rectangular base 101.

The oscillating arm 4 has a front end 41 pivotally connected with an axle 90 which is rotatably supported by a bracket 98. The bracket 98 is fixedly mounted on the lower side of the upper portion of the inverted U-shaped member 102. Both ends of the axle 90 are each provided with a first bevel gear 91 which is meshed with a second bevel gear 92. The second bevel gear 92 is fixedly fitted on a vertical shaft 99 which has a lower end rotatably mounted on the rectangular base 101 and an upper end fixedly engaged with an end of a lever 96. The other end of the lever 96 is fixedly connected with a lower end of a pectoral rod 91. A backrest 97 is arranged on the mounting 104 between the two pectoral rods 91. The oscillating arm 4 is provided with a rod member 43 extending horizontally outwardly therefrom.

The idle wheel 3 is rotatably mounted on a shaft 31 which is fastened on the mounting 104 so that the idle wheel 3 can be freely rotated with respect to the shaft 31. The position of the center of the idle wheel 3 is higher than the uppermost position that the rear end 42 of the oscillating arm 4 can reach.

The bi-directional electric motor 1 is fixedly arranged on the rectangular base 101 and can rotate in both directions.

The pulley 2 is formed with two parallel circular grooves 21 and 22 and fixedly mounted on an output shaft 11 of the electric motor 1. A first belt 5 is connected at one end with first groove 21 of the pulley 2 and wound round the first groove 21 in counter-clockwise direction (with respect to FIG. 1). The other end of the first belt 5 is secured to the rod member 43 mounted on the rear end 42 of the oscillating arm 4. A second belt 6 is connected at one end with the second groove 22 of the pulley 2 and wound round the second groove 22 in clockwise direction (with respect to FIG. 1). The second belt 6 is engaged with the idle wheel 3 and its the other end is secured to the rod member 43 of the oscillating arm 4.

Figure 4:
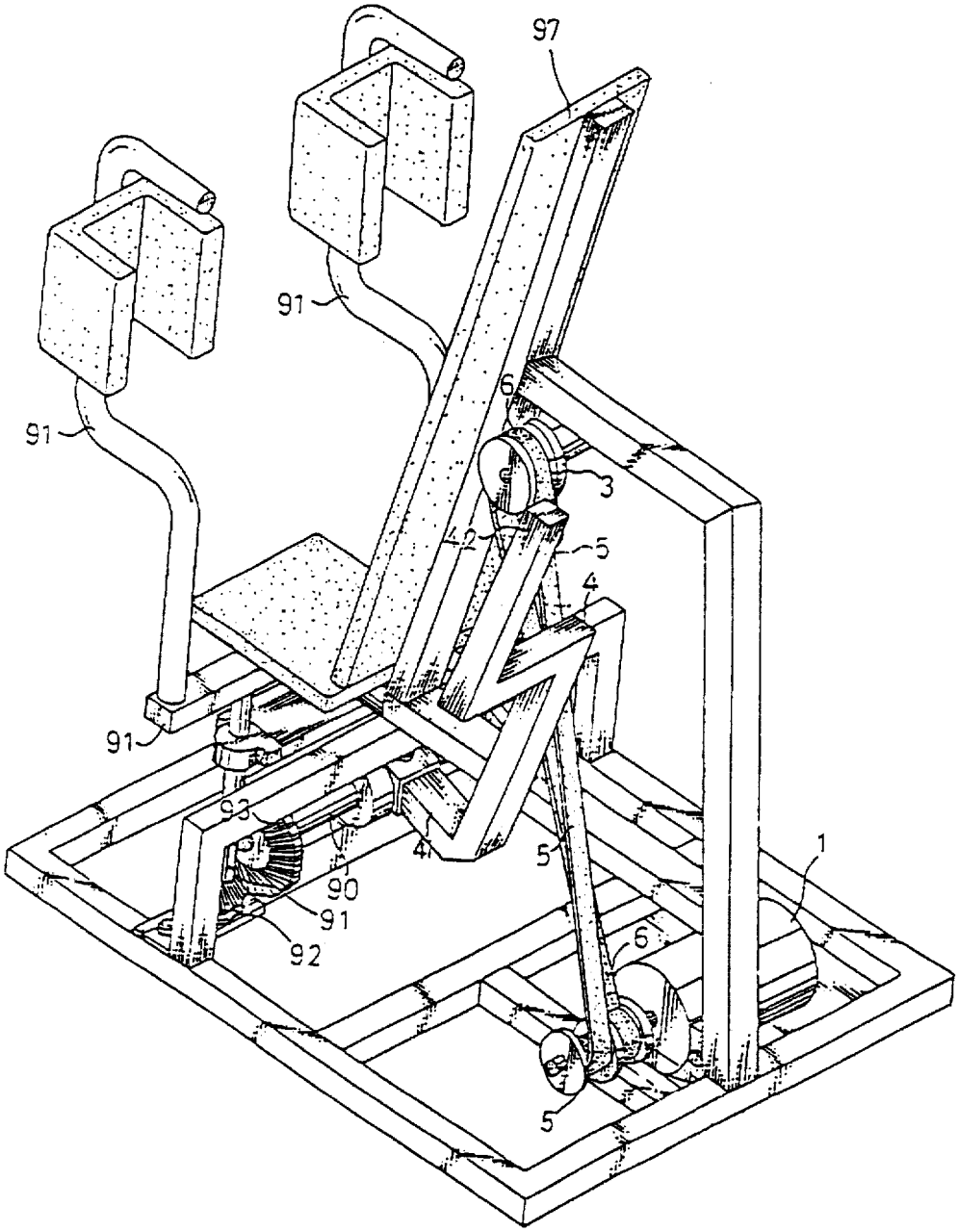
FIG. 4 is another perspective view of the present invention.

When the bi-directional electric motor 1 is turned on to rotate in clockwise direction, the pulley 2 will be rotated in the same direction thereby further winding up the first belt 5 round the first groove 21 of the pulley 2 and therefore pulling the rear end 42 of the oscillating arm 4 to go downwardly. Meanwhile, the belt 6 on the second groove 22 of the pulley 2 will be wound off since the belt 6 is wound thereround in counterclockwise direction. Hence, the pectoral rods 91 will be disposed in the position as shown in FIG. 1. As the rear end 42 of the oscillating arm 4 is located at the lowest position, the output axle 11 of the bi-directional electric motor 1 will be kept stationary and will tend to rotate in clockwise direction thereby providing a resistance against the movement of the pectoral rods 91. On the contrary, when the electric motor 1 is turned on to rotate in counterclockwise direction, the pulley 2 will be rotated in the same direction thereby further winding the second belt round the second groove 22 of the pulley 2 and therefore pulling the rear end 42 of the oscillating arm 4 to go upwardly. Meanwhile, the belt 5 on the first groove 21 of the pulley will be wound off since the belt 5 is wound thereround in clockwise direction. Hence, the pectoral rods 91 will be turned to the position as shown in FIG. 4. As the rear end 42 of the oscillating arm 4 is located at the uppermost position, the output axle 11 of the bi-directional electric motor 1 will be kept stationary and will tend to rotate in counterclockwise direction thereby providing a resistance against the movement of the pectoral rods 91. Thus, only when the user exerts a larger force on the pectoral rods 91 than the resistance applied to the pectoral rods 91 by the motor 1 will the user be able to rotate the pectoral rods 91 (see FIGS. 1, 2, 3 and 4).

The motor 1 may be computer-controlled so as to adjust the resistance applied to the axle 90 as desired. However, this technique may be of any conventional design well known to those skilled in the art and is not considered a part of the invention.

Figure 5:
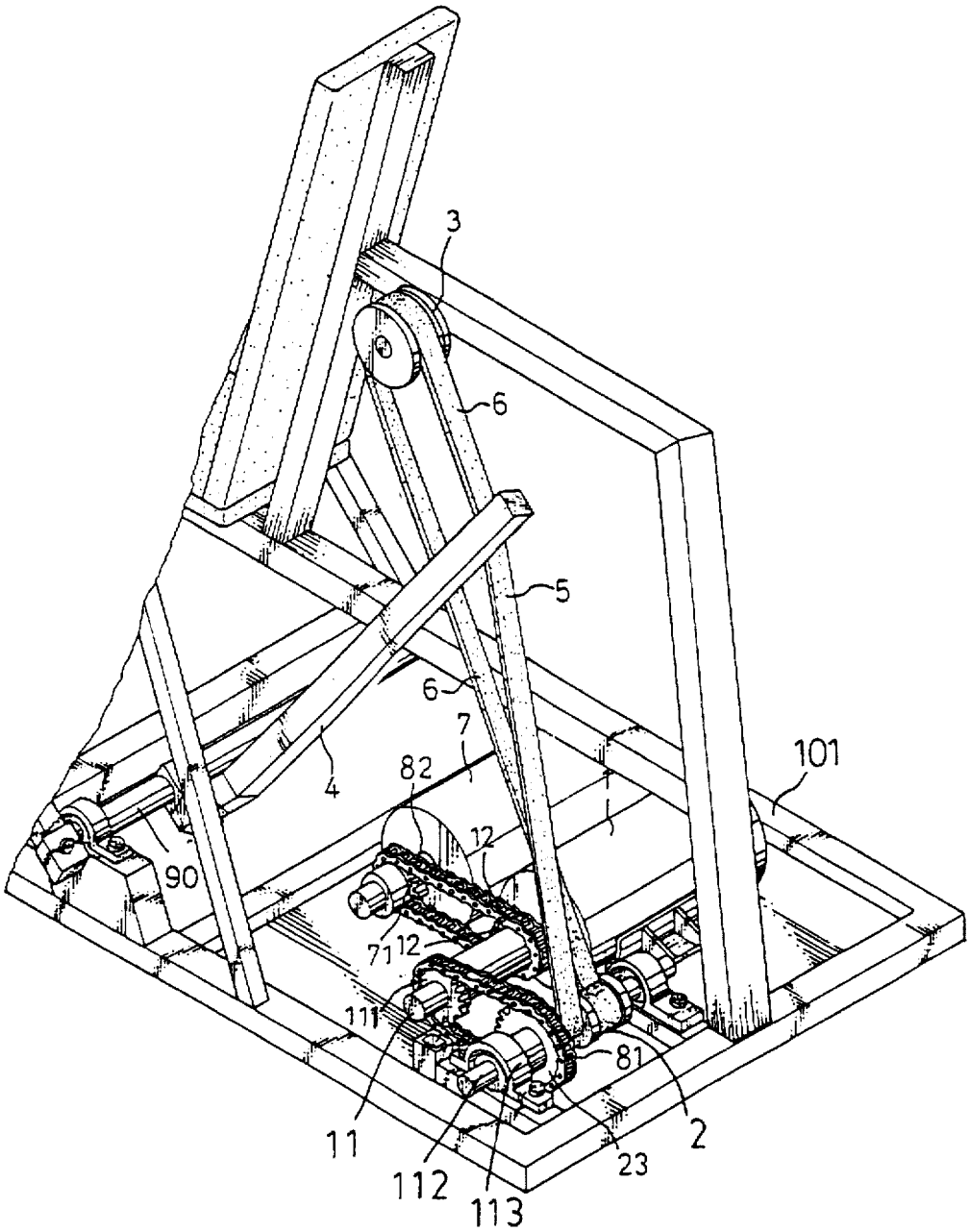
FIGS. 5 and 6 illustrate another preferred embodiment of the present invention.
Figure 6:
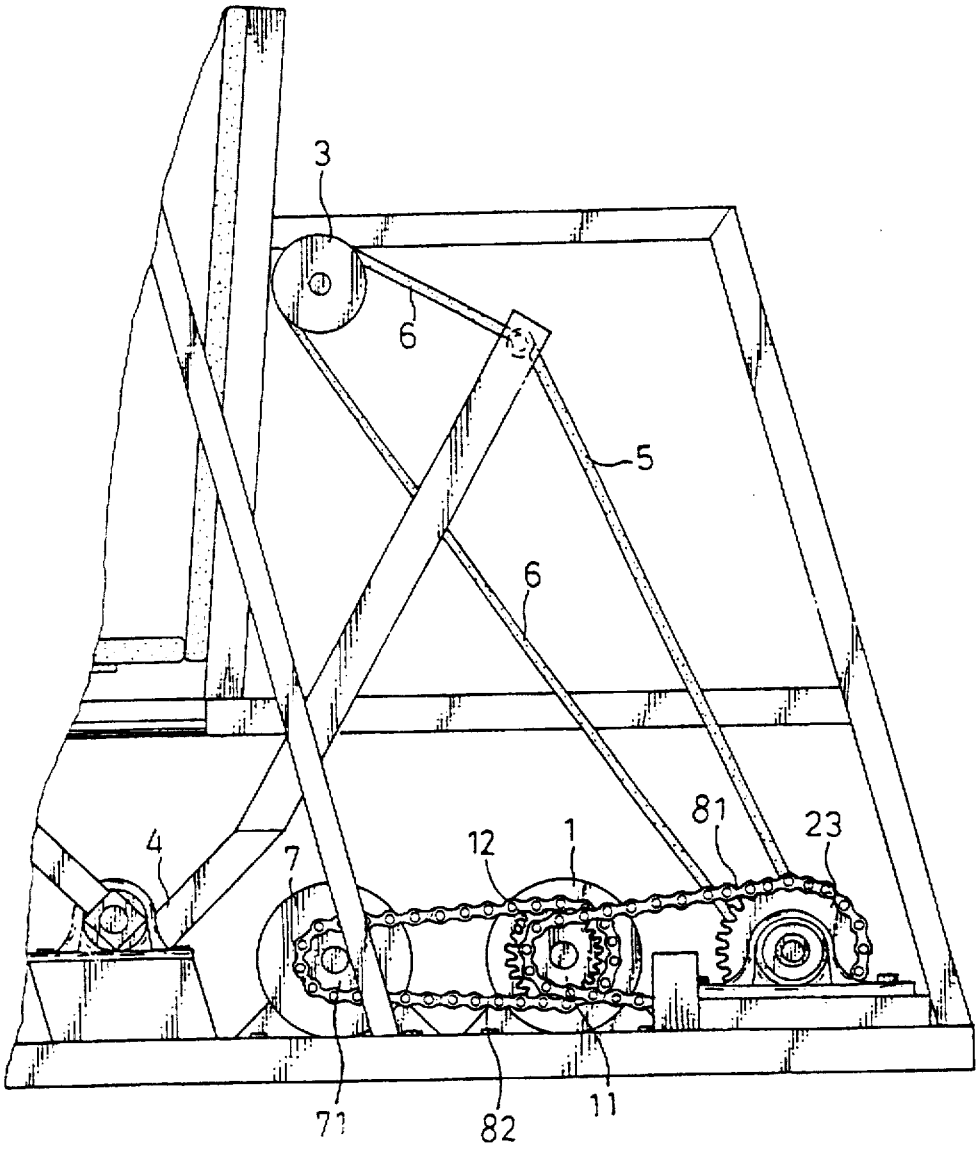
Figure 7:
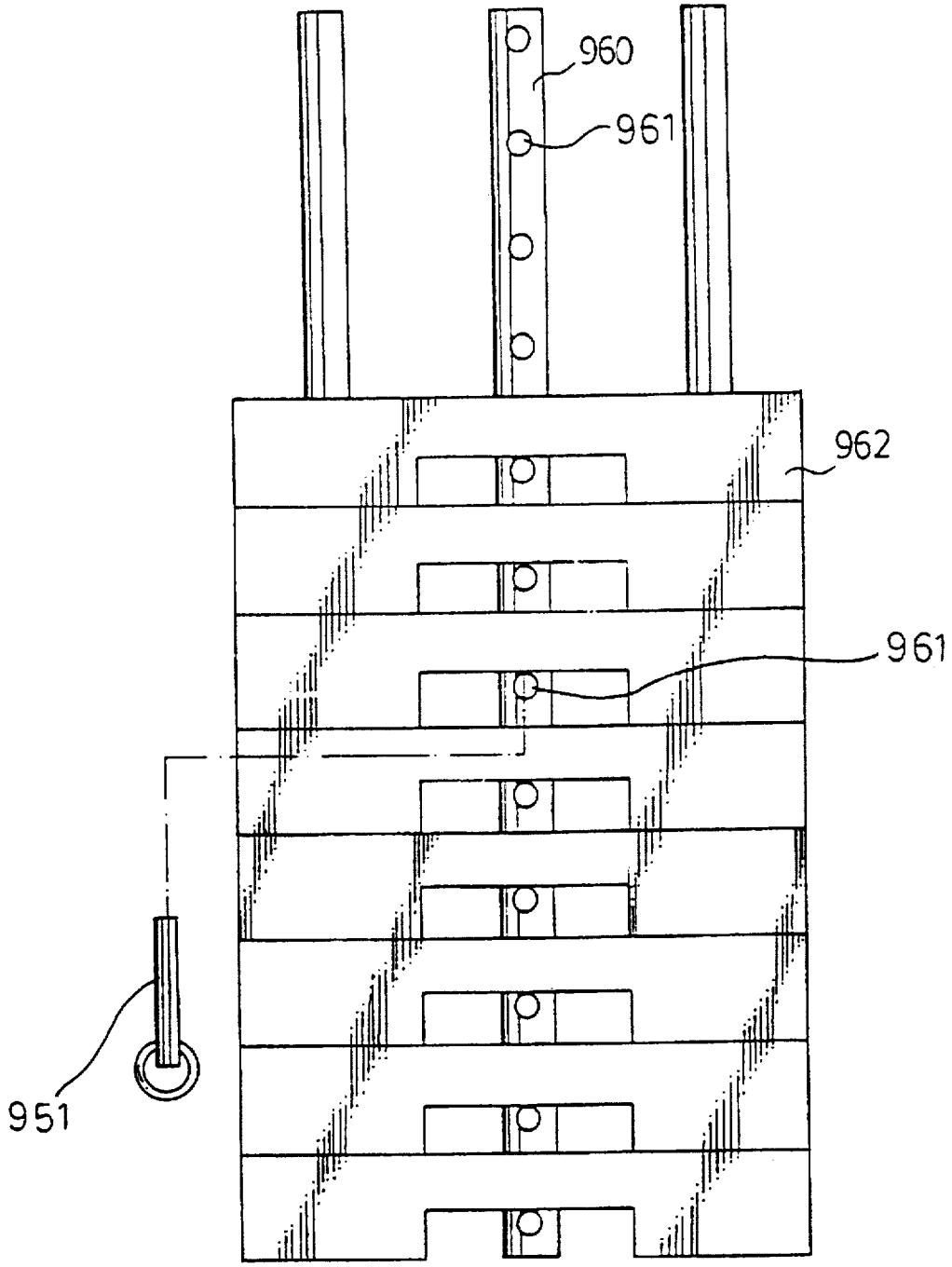
PRIOR ART FIG. 7
FIGS. 7 and 8 illustrate a prior art resistance mechanism for an exercising device.
Figure 8:
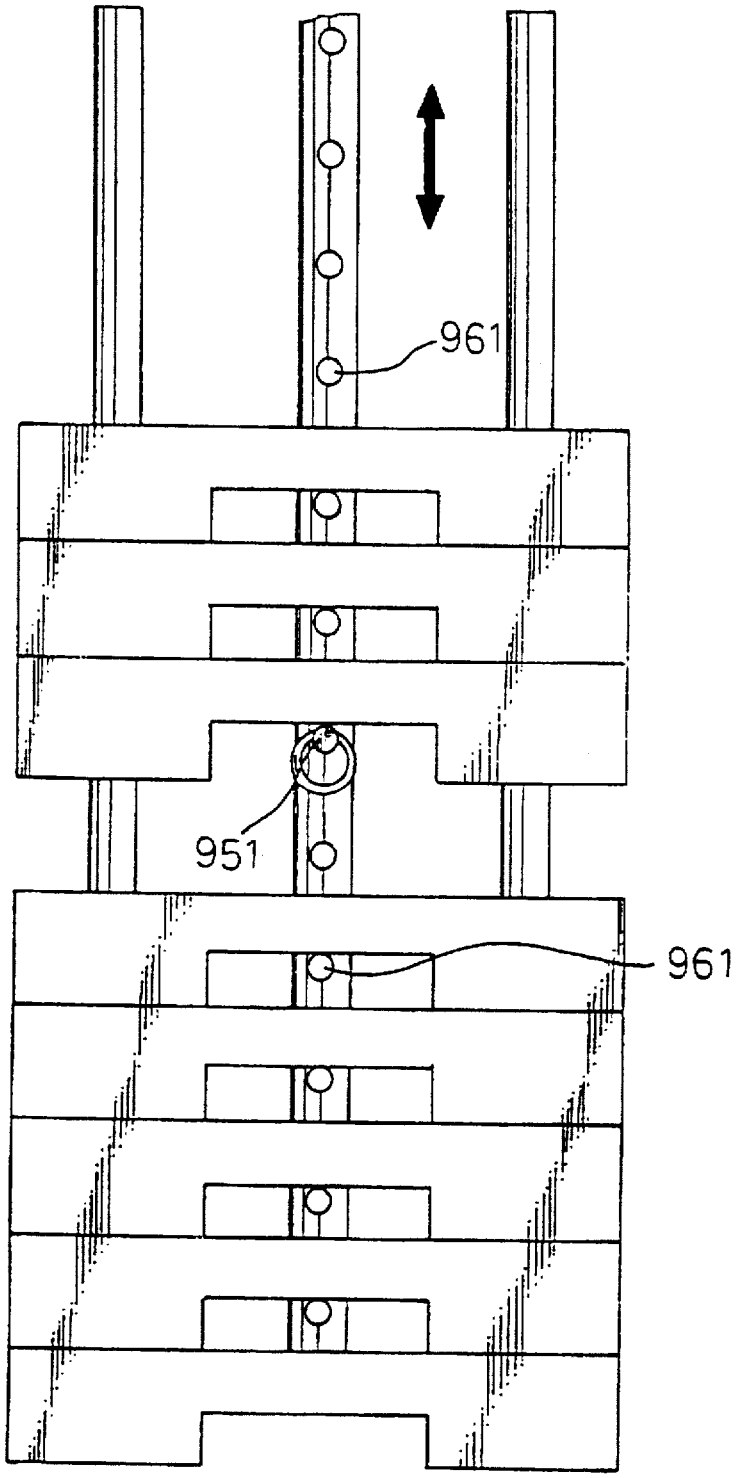
PRIOR ART FIG. 8

FIGS. 5 and 6 illustrate another preferred embodiment of the present invention. As illustrated, a first chain wheel 111 is fixedly mounted on the output axle 11 of the electric motor 1 and the pulley 2 is fastened on a shaft 112 which is journalled at two ends by two bearings 113 mounted on the rectangular base 101. A second chain wheel 23 is fixedly secured to the shaft 112 and connected with the chain wheel 111 via a chain 81. A third chain wheel 71 is fixedly mounted on an output axle of another electric motor 7 installed on the rectangular base 101 and connected with a chain wheel 12 mounted on the output axle 11 of the first electric motor 1 via a chain 82.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In an exercising device having an axle operatively connected with a resistance mechanism, said resistance mechanism comprising:

a frame;

a bi-directional electric motor installed on said frame and provided with an output axle;

a pulley fixedly mounted on said output axle and formed with two parallel circular grooves;

an idle wheel rotatably arranged on said frame;

a first belt having one end connected with one of said grooves of said pulley and wound thereon in a direction;

a second belt having one end connected with another one of said grooves of said pulley and wound thereon in an opposite direction and engaged with said idle wheel; and an oscillating arm having one end pivotally connected with said axle of said exericsing device and another end fixedly connected with another end of said first belt and another end of said second belt;

whereby a resistance force will be applied to said axle when said electric bi-directional motor is turned on.

* * * * *